United States Patent [19]

Akao et al.

[11] Patent Number: 4,960,626

[45] **Date of Patent: * Oct. 2, 1990**

[54] CONTAINER FOR PHOTOGRAPHIC FILM CARTRIDGE

[75] Inventors: Mutsuo Akao; Seiichi Watanabe; Takuichi Komatsu, all of Kanagawa, Japan

[73] Assignee: Fuji Photo Film Co., Ltd., Kanagawa, Japan

[ * ] Notice: The portion of the term of this patent subsequent to Jul. 4, 2006 has been disclaimed.

[21] Appl. No.: 364,557

[22] Filed: Jun. 8, 1989

Related U.S. Application Data

[63] Continuation of Ser. No. 60,537, Jun. 11, 1987, abandoned.

[30] Foreign Application Priority Data

Jun. 11, 1986 [JP] Japan ..... 61-133902

[51] Int. Cl.[5] ..... B65D 85/00

[52] U.S. Cl. ..... 428/36.92; 206/316.1; 206/407; 524/580

[58] Field of Search ..... 428/36.92; 524/580, 524/585; 206/455, 316.1, 407

[56] References Cited

U.S. PATENT DOCUMENTS

| | | | |
|---|---|---|---|
| 4,117,193 | 9/1978 | Tsuchiya et al. | 428/339 |
| 4,485,217 | 11/1984 | Gunter et al. | 525/240 |
| 4,639,386 | 1/1987 | Akao | 428/36.92 |
| 4,844,961 | 7/1989 | Akao | 428/36.92 |

*Primary Examiner*—James Seidleck

*Attorney, Agent, or Firm*—Burns, Doane, Swecker & Mathis

[57] ABSTRACT

In a container for a photographic film cartridge having a body and a cap made of a high-pressure branched low-density polyethylene resin and fitted to said body, the improvement comprising that said polyethylene resin has a melt index of 7 to 40 g/10 minutes and a density of 0.918 to 0.930 g/cm$^3$ and contains 0.05 to 1 wt. % of a fatty acid amide lubricant and that the bending rigidity of said cap is 1200 to 4000 kg/cm$^2$.

This resin for the cap is superior in fluidity, and molding troubles and coloring troubles at molding remarkably decrease. The molding cycle is also shortened. This cap is superior in fitness to the container body, and moisture sealing is improved.

5 Claims, 2 Drawing Sheets

FIG. 1
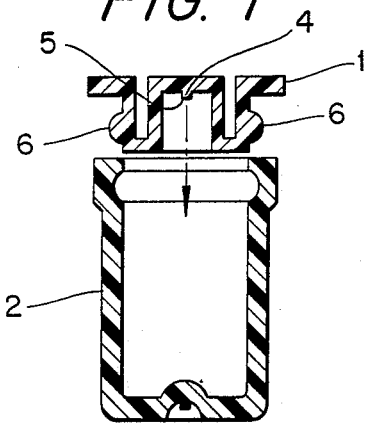
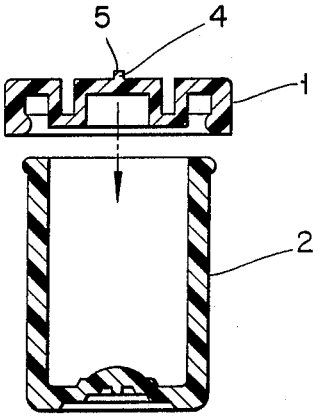
FIG. 2
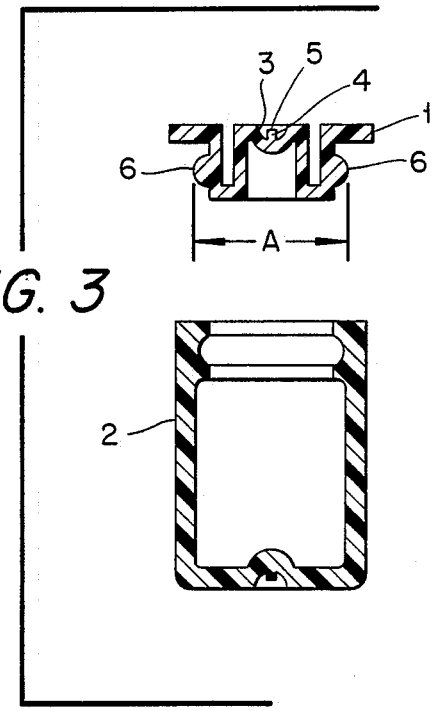
FIG. 3
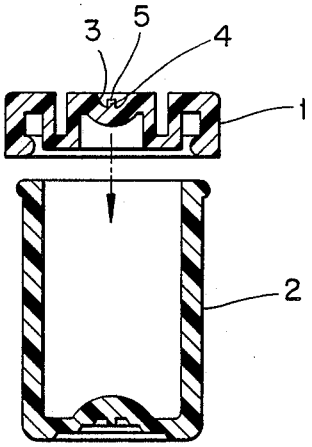
FIG. 4

CONTAINER FOR PHOTOGRAPHIC FILM CARTRIDGE

This application is a continuation of application Ser. No. 060,537, filed Jun. 11, 1987, now abandoned.

BACKGROUND OF THE INVENTION

1. Field of the Invention

This invention relates to a container for a photographic film cartridge which is characterized in its cap.

2. Description of the Prior Art

A conventional cap of a container for a photographic film cartridge was usually made of high-pressure branched low-density polyethylene (LDPE) resin having 0.927 g/cm$^3$ in density (ASTM D 1505) and 4.0 g/10 minutes in melt index (ASTM D 1238, MI). This resin is superior in flexibility at a low temperature, fitness of cap and body, compressive strength, has few, if any, burrs and gate marks.

However, in the case of using the LDPE resin, molding troubles, such as a short shot of the molten resin, warp, twist and deformation, frequently occur. Insufficient heat stability was also a problem. That is, the LDPE resin staying in a continuous molding machine at its screw, manifold, hot runner or other places was gradually colored brown or dark brown by heat. This colored resin was gradually extruded to cause coloring troubles. The generating rate of the colored products was high such as 3 to 10%, and these products should be extracted by a checker or a checking machine. A more important problem was that when coloring trouble occurred, the molding machine must be disassembled and washed to remove the colored resin completely. A great deal of effort and a long time were spent for this cleaning work. As another problem, since the MI of the LDPE resin was low, its temperature should be high at the molding. As a result, the molding cycle became long.

In order to solve the coloring problem, the cap was colored by blending carbon black. However, not only the appearance of the container became unfavorable, but also the manufacturing cost because elevated. Furthermore, when the whole container was colored black, the inside of the container became hot sunshine. This caused degradation of the photographic film in the container.

A metal container is also known (e.g. Japanese Utility Model KOKOKU No. 58-46413). However, the metal container was expensive, and its mass-producibility was inferior to a plastic container. Accordingly, it is not utilized, now.

SUMMARY OF THE INVENTION

An object of the invention is to provide a container for a photographic film cartridge having a cap which is produced without coloring troubles or molding troubles.

Another object of the invention is to provide a container for a photographic film cartridge having a cap of suitable bending rigiditiy and acceptable moldability.

Another object of the invention is to provide a container for a photographic film cartridge having a cap which is made of a resin capable of lowering the molding temperature and is thereby capable of shortening its molding cycle.

Still another object of the invention is to provide a container for a photographic film cartridge having a cap which can be made transparent or translucent thereby avoiding the in the sunshine.

Such objects are achieved by a cap containing a particular polyethylene resin.

BRIEF DESCRIPTION OF THE DRAWINGS

FIGS. 1 to 4 are sectional side views indicating several examples of the container to which the present invention is applied.

DETAILED DESCRIPTION OF THE INVENTION

Figure 5:
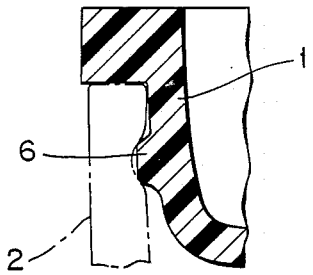
FIGS. 5 to 8 are partial sectional views indicating the fitting structure of some other caps to which the present invention is applied.

The cap of the invention is composed of a particular high-pressure branched low-density polyethylene (LDPE) resin characterized by melt index and density, blending of a lubricant and adjusting its bending rigidity.

The melt index (MI) of the LDPE resin is 7 to 40 g/10 minutes. In the case of lower than 7 g/10 minutes, moldability becomes worse, and warp, stringiness and other problems occur. The molding cycle is also lengthened. In order to improve moldability, the molding temperature should be raised. As a result, coloring troubles frequently happen, and the molding cycle is lengthened because of the lengthening of the cooling period. On the other hand, in the case of a melt index higher than 40 g/10 minutes, the resin is too plastic, and molding troubles such as a collapse of the rib of the cap, ejection trouble, stringiness and burrs frequently occur.

The density of the LDPE resin is 0.918 to 0.930 g/cm$^3$. In the case of lower than 0.918 g/cm$^3$, coloring troubles occur. Besides, the resin is too plastic, and deformation of the rib of the cap fitted into the groove of the container body occurs upon removal from its mold. While, in the case of a density higher than 0.930 g/cm$^3$, the resin becomes too rigid, and the fitness of the cap to the body becomes worse. As a result, the cap is liable to detach at dropping, and the moisture permeability becomes too great. Commercial LDPE resins are "SUMIKATHENE" (SUMITOMO CHEMICAL CO., LTD.). "MITSUBISHI POLYETHY" (MITSUBISHI PETROCHEMICAL CO., LTD.), "MIRASON" (MITSUI POLYCHEMICALS CO., LTD.), "NUC POLYETHYLENE" (NIPPON UNICAR CO., LTD.), "UBE POLYETHYLENE" (UBE INDUSTRIES LTD.), "NISSEKI REXLON" (NIPPON PETROCHEMICALS CO., LTD.), "NIPOLON" (TOYO SODA MANUFACTURING CO., LTD.), "SHOLEX" (SHOWA DENKO K.K.), "NOVATEC-L" (MITSUBISHI CHEMICAL INDUSTRIES LTD.), "SUNTEC-LD" (ASAHI CHEMICAL INDUSTRIES CO., LTD.), etc.

The fatty acid amide lubricant not only improves injection of the LDPE resin into the mold and removal of the cap from the mold, but also improves the fitness of the cap to the body. It also makes detachment of the cap easy, and the rib of the cap is not deformed at the detachment. In the instances of other lubricants, fogging trouble occurs in the photographic film placed in the container. Moreover, in the case of silicone lubricant, the cap becomes opaque. The content of the fatty acid amide lubricant is 0.05 to 1 wt. %. When the content is less than 0.05 wt. the above effects become insufficient. While, when the content is more than 1 wt. %, the cap becomes sticky, and molding machine slips, and thereby, the molding cycle is lengthened. Examples of commercial lubricants suitable for the present invention include:

Oleic acid amide lubricants; "ARMOSLIP-CP" (Lion akzo Co., Ltd.), "NEWTRON" and "NEWTRON E-18" (Nippon Fine Chemical Co., Ltd.), "AMIDE-O" (Nitto Kagaku K.K.), "DIAMID O-200" and "DIAMID G-200" (Nippon Kasei Chemical Co., Ltd.), "ALFOW E-10" (Nippon Oil and Fats Co., Ltd.)

Erucic acid amide lubricants; "ALFLOW P-10" (Nippon Oil and Fats Co., Ltd.)

Stearic acid amide lubricants; "ALFLOW S-10" (Nippon Oil and Fats Co., Ltd.), "NEWTRON 2" (Nippon Fine Chemical Co., Ltd.), "DIAMID 200" (Nippon Kasei Chemical Co., Ltd.)

Bis fatty acid amide lubricants; "BISAMIDE" (Nitto Kagaku K.K.), "DIAMID-200 BIS" (Nippon Kasei Chemical Co., Ltd.), "ARMOWAX-EBS" (Lion Akzo Co., Ltd.)

A phenol oxidation inhibitor or a phosphite oxidation inhibitor is preferably added in order to prevent coloring of the resin. Other oxidation inhibitors are not preferable because they adversely influence the photographic film. A suitable content of the oxidation inhibitor is 0.01 to 1.5 wt. %. When the content is less than 0.01 wt. %, the blending effect becomes insufficient. While, when the content is more than 1.5 wt. %, it adversely influences the photographic film due to an oxidation-reduction reaction. The phenol oxidation inhibitors include n-octadecyl-3-(3', 5'-di-t-butyl-4'-hydroxyphenyl)propionate, 2,6-di-t-butyl-4-methylphenol, 2,6-di-t-butyl-p-cresol, 2,2'-methylenebis (4-methyl-6-t-butylphenol), 4,4-thiobis-3-methyl (3-methyl-6-t-butylphenol), 4,4'-butylidenebis(3-methyl-6-t-butylphenol), stearyl-$\beta$-(3,5-di-4-butyl-4-hydroxyphenyl) propionate, 1,1,3-tris(2-methyl-4-hydroxy-5-t-butylphenyl) butane, 1,3,5-trimethyl-2,4,6-tris(3,5-di-t-butyl-4-hydroxybenzyl)benzene and tetrakis[methylene-3-(3',5'-di-t-butyl-4'-hydroxyphenyl)propionate]methane. The phosphorus-containing oxidation inhibitor includes trinonylphenylphosphite and triphenylphosphite. Commercial products belonging to the phenol oxidation inhibitors include various "IRGANOX" (CIBA-GEIGY AG) and "SUMILIZER BHT", "SUMILIZER BP-76", "SUMILIZER WX-R" and "SUMILIZER BP-101" (SUMITOMO CHEMICAL CO., LTD.). Two or more oxidation inhibitors may be combined.

Bending rigidity of the cap is 1200 to 4000 kg/cm$^2$, and in view of the fitness to the container body, it is preferably less than one half of the bending rigidity of the container body.

A coloring material may also be blended. As the coloring material, dye, pigment, metal powder, metal fiber and metal flake are usable. Examples of the coloring material are as follows:

White coloring material; Titanium dioxide, calcium carbonate, mica, zinc oxide, clay, barium sulfate, calcium sulfate, magnesium silicate, etc.

Yellow coloring material; Titanium yellow, yellow iron oxide, chrome titanium yellow, diazo pigment, vat pigment, quinophthalene pigment, isoindolenone, etc.

Red coloring material; Red iron oxide, diazo pigment, berlin pigment, monoazo lake pigment, condensed azo pigment, etc.

Blue coloring material; Cobalt blue, ultramarine, Cyanine Blue, etc.

Green coloring material; Chromium oxide green, titanium green, Cyanine Green, etc.

Black coloring material; Carbon black, black iron oxide, etc.

Silver coloring material; Aluminum powder, aluminum paste, tin powder, etc.

Among them, carbon black is preferable because of its synergistically antioxidative effect, shielding of coloring trouble and inexpensiveness. The content of the coloring material is preferably less than 3 wt. % such as 0.1 to 1 wt. %.

Various additives in addition to the mentioned previously may be added to the resin for cap. Examples of the additives are described below.

(1) Plasticizer;
phthalic acid esters, glycol esters, fatty acid esters, phosphoric acid esters, etc.

(2) Stabilizer;
lead compounds, cadmium compounds, zinc commpounds, alkaline earth metal compounds, organic tin compounds, etc.

(3) Antistatic agent; cationic surfactants, anionic surfactants, nonionic surfactants, ampholytic surfactants, etc.

(4) Flame retardant;
phosphoric acid esters, phosphoric acid ester halides, halides, inorganic materials, polyols containg phosphorous, etc.

(5) Filler;
alumina, kaolin, clay, calcium carbonate, mica, talc, titanium dioxide, silica, etc.

(6) Reinforcing agent;
glass lobing, metallic fiber, glass fiber, glass milled fiber, carbon fiber, etc.

(7) Nucleating agent;
inorganic nucleating agent, organic nucleating agents (such as dibenzylidenesorbitol)

(8) Vulcanizing agent;
vulcanization accelerator, acceleration assistant, etc.

(9) Deterioration preventing agent;
ultraviolet absorber, metal deactivator, peroxide decomposing agent, etc.

(10) Coupling agent;
silane compounds, titanium compounds, chromium compounds, aluminum compounds, etc.

Figure 6:
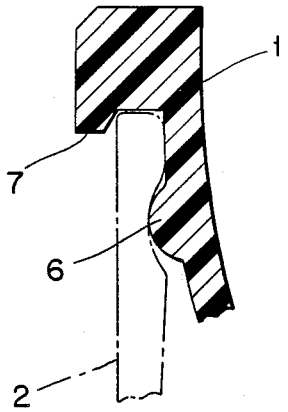
Figure 7:
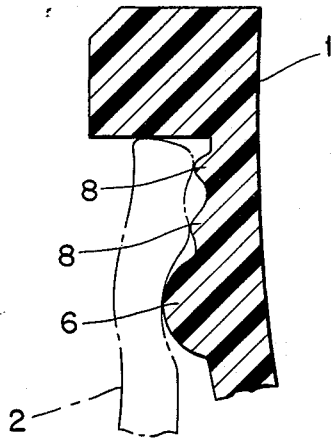
Figure 8:
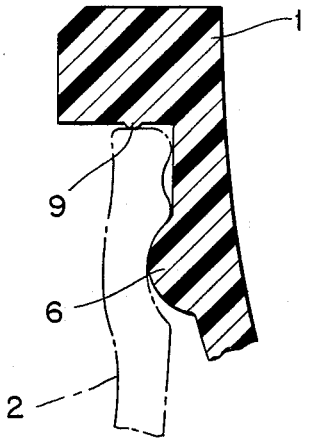

(11) Various thermoplastic resins, rubbers, particularly, polyolefin thermoplastic resins The cap of the invention is a fitting type. Its form is not limited, and however, the caps in FIGS. 1 to 4 are preferable in view of good fitness to the body of the container to bring sufficient sealing and ease of detachment. In the drawings, 1 represents the cap, and 2 represents the container body. Particularly, the caps of FIGS. 1 and 3 are preferable because it can be detached by one hand. As shown in FIGS. 3 and 4, an indent 5 may be formed around a gate mark 5, and the gate mark 5 is provided in it so as not to project outwardly. This structure is preferable in points of appearance and molding. As shown in FIG. 5, the top of the rib 6 may be cut off, and as shown in FIG. 6, an engaging edge 7 may be formed. Besides, as shown in FIG. 7, one or more projecting rings 8 may be formed above the ribs 6, and as shown in FIG. 8, a projecting ring 9 may be formed on the reverse face of flange of cap to touch upper edge of the container body.

The molding method of the cap is not limited, and the cap may be produced by hot runner type injection molding, inter mold vacuum injection molding or stack molding.

The cap of the invention is made of a high MI LDPE resin blended with a particular lubricant, and the melt viscosity of the resin is low at low temperature. Therefore, melted resin smoothly flows in the screw of a molding machine without noted problem of excessive heat build-up when the container is placed which is a cause of coloring. Melt fracture are not generated, and therefore, troubles in appearance of the molded cap hardly occur. Since contraction of the molded cap is small at cooling, and since the molding temperature can be low, the cooling time of the molded cap can be shortened. For these reasons, the molding cycle can be shortened. Coloring troubles hardly occur because of the low molding temperature and smooth fluidity in addition to the heat stability of the resin. Molding troubles such as short shot, warp, twist and deformation are rare, and stringiness and the occurrence of burrs decrease Since the fitting strength of the cap to its container body is in a prescribed range, the cap is rarely detached during the packaging process. Furthermore, the moisture permeability is low because of the fitting strength.

EXAMPLES

Seven examples of the cap of the invention, two comparative caps and one conventional cap were molded by using the molding machine "IS 75E" (manufactured by TOSHIBA MACHINE CO., LTD.) at mold clamping pressure of 75 t. The molding number per once was 2, and the type of runner was a hot runner.

The forms of the molded caps are all shown in FIG. 3 except Example 7. The cap of Example 7 is shown in FIG. 5.

The MI of the LDPE resin employed in Examples 1 to 5 and 7 was 20.0 g/10 minutes, and its density was 0.926 g/cm$^3$ MI of the LDPE resin employed in Examples 4 to 6 was 23.0 g/10 minutes, and its density was 0.924 g/cm$^3$. The following content of oleic acid amide lubricant was added to each resin.

| | |
|---|---|
| Example 1 | 0.1 wt. % |
| Example 2 | 0.3 |
| Example 3 | 0.5 |
| Example 4 | 0.1 |
| Example 5 | 0.3 |
| Example 6 | 0.5 |
| Example 7 | 0.5 |

The LDPE resin of Comparative Example 1 was the same as employed in Examples 1 to 3 and 7. A lubricant was not added.

The LDPE resin of Comparative Example 2 was the same as employed in Examples 4 to 6. A lubricant was not added.

The MI of the LDPE resin of Conventional Example was 4.0 g/10 minutes, and its to density was 0.927 g/cm$^3$.

The molding temperature of Examples 1 to 3 and 7 and Comparative Example 1 was 155° C., and that of Examples 4 to 6 and Comparative Example 2 was 150° C. Molding temperative of Conventional Example was 190° C.

Various properties of the molded caps are shown in Table 1. The container body of FIG. 3 was employed in every Example.

TABLE 1

| | | Invention | | | | | | | Comparative | | Conventional |
|---|---|---|---|---|---|---|---|---|---|---|---|
| | Unit | 1 | 2 | 3 | 4 | 5 | 6 | 7 | 1 | 2 | |
| MI | g/10 min. | 20.0 | 20.0 | 20.0 | 23.0 | 23.0 | 23.0 | 20.0 | 20.0 | 23.0 | 4.0 |
| Density | g/cm$^3$ | 0.926 | 0.926 | 0.926 | 0.924 | 0.924 | 0.924 | 0.926 | 0.926 | 0.924 | 0.927 |
| Bending Rigidity | kg/cm$^2$ | 1700 | 1700 | 1700 | 1480 | 1480 | 1480 | 1700 | 1700 | 1480 | 3100 |
| Minimum Cycle Time | sec. | 5.6 | 5.2 | 4.7 | 5.5 | 5.0 | 4.8 | 4.8 | 9.8 | 10.6 | 6.0 |
| Injection Pressure | kg | 85 | 83 | 81 | 83 | 81 | 80 | 81 | 100 | 90 | 118 |
| Molding Temperature | C | 155 | 155 | 155 | 150 | 150 | 150 | 155 | 155 | 150 | 190 |
| Contraction at Cooling | % | 0.21 | 0.20 | 0.19 | 0.22 | 0.20 | 0.18 | 0.18 | Cannot be Molded | Cannot be Molded | 0.48 |
| Fitting Strength | kg | 1.73 | 1.65 | 1.59 | 1.58 | 1.53 | 1.50 | 2.7 | — | — | 1.17 |
| Moisture Permeability | mg/24 hrs. | 1.7 | 2.1 | 2.4 | 2.4 | 2.5 | 2.8 | 1.1 | — | — | 4.3 |
| Coloring Troubles | — | B | B | B | B | B | B | B | B | B | E |
| Molding Troubles | — | B | B | B | B | B | B | B | C | D | C |
| Cap | — | A | B | B | B | B | B | A | B | B | D |

TABLE 1-continued

| | Unit | Invention 1 | 2 | 3 | 4 | 5 | 6 | 7 | Comparative 1 | 2 | Conventional |
|---|---|---|---|---|---|---|---|---|---|---|---|
| Detachment | | | | | | | | | | | |

Evaluation in Table 1 were carried out as follows.
A very excellent
B excellent
C practical
D having a problem
E impractical
Testing methods are as follows:
Melt Index; ASTM D-1238 (at 190° C.)
Density; ASTM D-1505
Bending Rigidity; ASTM D-747
Minimum Cycle Time; Time of one shot of injection-cooling-taking out at the optimal molding condition.
Molding Temperature; The resin temperature at the optimal molding condition for each resin where molding trouble hardly occurs.
Contraction at Cooling; The contraction of A indicated in FIG. 3 at the time when cooling time was shortened 1 second by shortening the molding cycle time from 7 seconds to 6 seconds.

$$\frac{\text{Rib diameter at 7 sec.} - \text{Rib diameter at 6 sec.}}{\text{Rib diameter at 7 sec.}} \times 100$$

Fitting strength; A spring balance was provided with a grip member. Each cap was grasped by the grip member, and the spring balance was pulled in just the upward direction. The force necessary to detach each cap was measured.
Moisture Permeability; About 4 g of calcium chloride was exactly weighed, and placed in each container. Each cap was attached, and the container was allowed to stand in a room controlled at 40° C. and 90% in humidity for 24 hours. The increase in the weight of calcium was exactly weighed by a precision balance, and the increase was employed as moisture permeability.
Coloring Degree; Coloring degree of the product produced continuously at the optimal temperature for each resin without molding trouble.
Molding Trouble; Occurrence of molding trouble such as warp, bottom sink mark, short shot and burr at the optimal molding condition for each resin.
Cap Detachment; A photographic film cartridge containing a photographic film of 36 exposures ("Fuji Color Hr-100", 36 Ex.) was placed in each container. Each container was dropped from 5 meters height to concrete floor, and the number of cap-detached containers were counted. In order to avoid the detachment of cap caused by broken of container body, a container body made of polypropylene resin containing polyethlene in a high content was used.

We claim:

1. In a container for a photographic film cartridge having a body and a cap, said cap being fitted to said body and said cap being made of a high-pressure branched low-density polyethylene resin, the improvement comprising that said polyethylene resin of said cap has a melt index of 7 to 40 g/10 minutes and a density of 0.918 to 0.930 g/cm$^3$ and contains 0.05 to 1 wt. % of a fatty acid amide lubricant and said cap has a bending rigidity of 1200 to 1400 kg/cm$^2$.

2. The container of claim 1 wherein said fatty acid amide lubricant is selected from the group consisting of oleic acid amide lubricant, erucic acid amide lubricant, stearic acid amide lubricant and bis fatty acid amide lubricant.

3. The container of claim 1 wherein said polyethylene resin further contains 0.01 to 1.5 wt. % of a phenol oxidation inhibitor or a phosphite oxidation inhibitor.

4. The container of claim 1 wherein said polyethylene resin further contains a coloring material.

5. In a container for a photographic film cartridge having a body and a cap, said cap being fitted to said body and said cap being made of a high-pressure branched low-density polyethylene resin and fitted to said body, the improvement comprising that said polyethylene resin of said cap has a melt index of 7 to 40 g/10 minutes and a density of 0.918 to 0.930 g/cm$^3$ and contains 0.05 to 1 wt. % of a fatty acid amide lubricant selected from the group consisting of oleic acid amide lubricant, erucic acid amide lubricant, stearic acid amide lubricant and bis fatty acid amide lubricant, 0.01 to 1.5 wt. % of a phenol oxidation inhibitor or a phosphite oxidation inhibitor and a coloring material, and said cap has a bending rigidity of 1200 to 1400 kg/cm$^2$.

* * * * *